US006279624B1

(12) United States Patent
Corfitsen

(10) Patent No.: US 6,279,624 B1
(45) **Date of Patent: *Aug. 28, 2001**

(54) DEVICE FOR POSITIONING AT AUTOMATIC FUELLING OF VEHICLES

(75) Inventor: Sten Corfitsen, Lidingö(SE)

(73) Assignee: Autofill Patent AB, Lidingo (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/424,444

(22) PCT Filed: May 26, 1998

(86) PCT No.: PCT/SE98/00988

§ 371 Date: Feb. 16, 2000

§ 102(e) Date: Feb. 16, 2000

(87) PCT Pub. No.: WO98/54084

PCT Pub. Date: Dec. 3, 1998

(30) Foreign Application Priority Data

May 28, 1997 (SE) ..... 9702011

(51) Int. Cl.[7] ..... B65B 1/04

(52) U.S. Cl. ..... 141/231; 141/98; 141/232

(58) Field of Search ..... 141/94, 98, 59, 141/99–231, 232, 250, 351, 352, 387, 388, 301, 302; 342/140; 340/825

(56) References Cited

U.S. PATENT DOCUMENTS 4,881,581 * 11/1989 Hollerback ..... 141/113
5,383,500 * 1/1995 Dwars et al. ..... 141/98
5,392,049 * 2/1995 Gunnarsson ..... 342/42

FOREIGN PATENT DOCUMENTS

405112396A * 5/1993 (JP) .

* cited by examiner

*Primary Examiner*—Timothy L. Maust
*Assistant Examiner*—Khoa Huynh
(74) *Attorney, Agent, or Firm*—Alfred J. Mangels

(57) ABSTRACT

Automatic refuelling of vehicles, primarily cars, is effected by a fuelling robot. An optical sensor is disposed adjacent the fuelling robot and is adapted to detect optically the position of the fuel-tank flap of a vehicle parked for fuelling purposes, relative to the rest position of the robot head. The sensor is also adapted to detect the position of the orifice of the fuel-tank filler pipe relative to the position of the robot head. A computer receives position signals from the sensor and guides a robot-carried opening device into abutment with the fuel-tank flap to open the flap, and to effect docking of a fuelling nozzle within the fuel-tank filler pipe orifice.

16 Claims, 3 Drawing Sheets

DEVICE FOR POSITIONING AT AUTOMATIC FUELLING OF VEHICLES

BACKGROUND OF THE INVENTION

1. Field of the Invention

The present invention relates to an arrangement for positioning a robot for the automatic fuelling of vehicles, primarily cars.

2. Description of the Related Art

An arrangement for the automatic fuelling of cars is described in Swedish Patent Specification No. 8901674-5.

The arrangement according to this prior patent specification comprises a robot which includes a fuelling nozzle or corresponding device, and which when the vehicle is located in a predetermined position in relation to the robot functions to move the fuelling nozzle automatically from a rest position to a vehicle fuelling position in response to sensing and control means. The fuelling nozzle includes a rigid first tube which is adapted to be moved by the robot towards an adapter provided with a hole associated with the vehicle fuelling location. A flexible, second tube is arranged for movement within the first, rigid tube from a first end position in which the outer free end of the second tube is located within the first tube, to a second position in which the second tube projects out from the first tube. A tube connection is provided between said hole and the vehicle fuel-tank pipe. The robot is constructed to move the free end of the second tube axially out of the first tube and down into said tube connection, or down into the vehicle fuel-tank pipe, and pump fuel through the second tube and into the fuel tank.

Swedish Patent Specification No. 9202550-1 describes a method of opening and closing the fuelling-tank flap of a vehicle.

According to this latter patent specification, a vehicle-mounted transponder which co-acts with a transceiver unit fitted to the robot head contains information relating to the particular pattern of movement, or movement plan, that is to be carried oust by the robot head in relation to the vehicle to be fuelled at that time. The transceiver unit also co-acts with the transponder to initially position the robot head in relation to the vehicle.

It is desired to simplify this positioning process and also the flap opening process. It is also desired to obviate the use of microwave equipment.

These objects are fulfilled by the present invention.

SUMMARY OF THE INVENTION

The present invention thus relates to a positioning system or arrangement pertaining to the automatic fuelling of vehicles, primarily cars. The arrangement comprises a robot which includes a robot head that is movable relative to the robot so as to enable the robot head to be brought to a predetermined position in relation to the vehicle fuel-tank pipe from a rest position by means of a positioning system. The robot head includes an outer tube and an inner tube which is housed within said outer tube and movable axially out of said tube, wherein the outer tube is intended to be docked with an adapter attached to the upper orifice of the fuel-tank pipe, subsequent to docking said outer tube, the free forward end of the inner tube is intended to be projected to a lower position in the fuel-tank pipe, whereafter fuel is delivered through the inner tube. The robot head carries a flap opening device which functions to open a fuel-tank flap in response to movements of the robot head, wherein the robot head movements are effected in accordance with a predetermined movement plan or pattern. The positioning system includes an optical sensor means disposed adjacent the robot and adapted to detect optically the position of the fuel-tank flap of a vehicle parked for fuelling, relative to the rest position of the robot head, and therewith deliver to a robot computer a signal relating to said relative position. The computer is programmed to guide an opening device on said robot into abutment with the fuel-tank flap and open said flap in accordance with a predetermined movement plan. The sensor means functions to detect the position of the orifice of the fuel-tank pipe or the adapter relative to the current position of the robot head, after the fuel-tank flap has been opened, and sends to the computer a signal relating to said relative position. The computer thereafter causes the robot head to carry out said docking and also to carry out said movements in the reverse order when fuelling has been completed, and therewith close the fuel-tank flap.

BRIEF DESCRIPTION OF THE DRAWINGS

The invention will now be described in more detail with reference to exemplifying embodiments thereof and also with reference to the accompanying drawings, in which.

DESCRIPTION OF THE PREFERRED EMBODIMENTS

Figure 1:
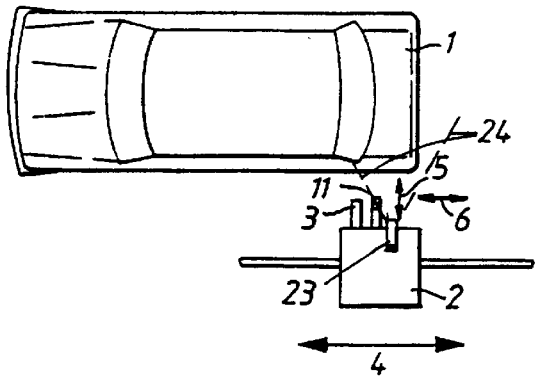
FIG. 1 illustrates a vehicle parked adjacent a robot of the kind in question viewed from above.

FIG. 1 is a schematic illustration of a vehicle automatic fuelling station, primarily for cars 1, which includes a robot 2 that has a robot head 3 which is movable relative to the robot so as to enable said head to be brought to a predetermined position relative to the fuel-tank pipe of the vehicle. The robot is movable in the directions indicated by the double-headed arrow 4. The robot head 3 is movable in the directions indicated by the double-headed arrows 5 and 6 and also in a direction perpendicular to the plane of the paper.

Figure 3:
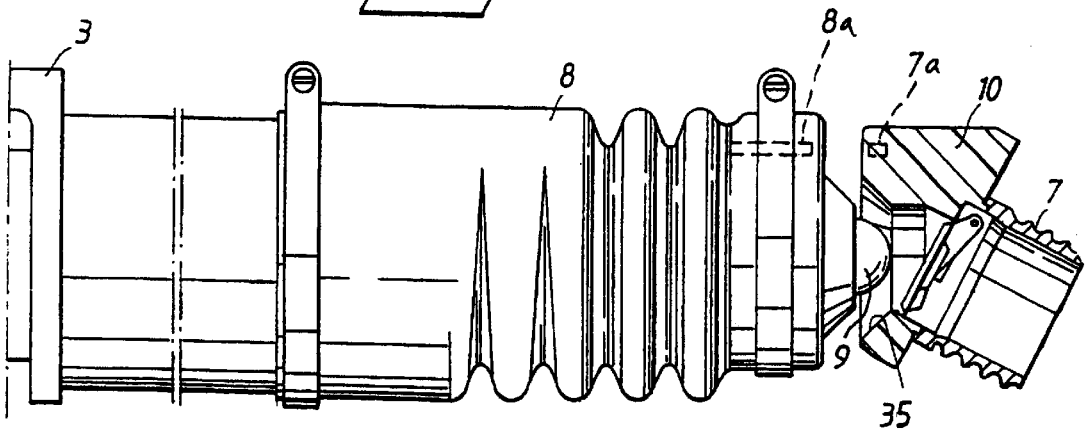
FIG. 3 illustrates the front part of a robot head and an adapter attached to the upper orifice of a vehicle fuel-tank pipe.
Figure 4:
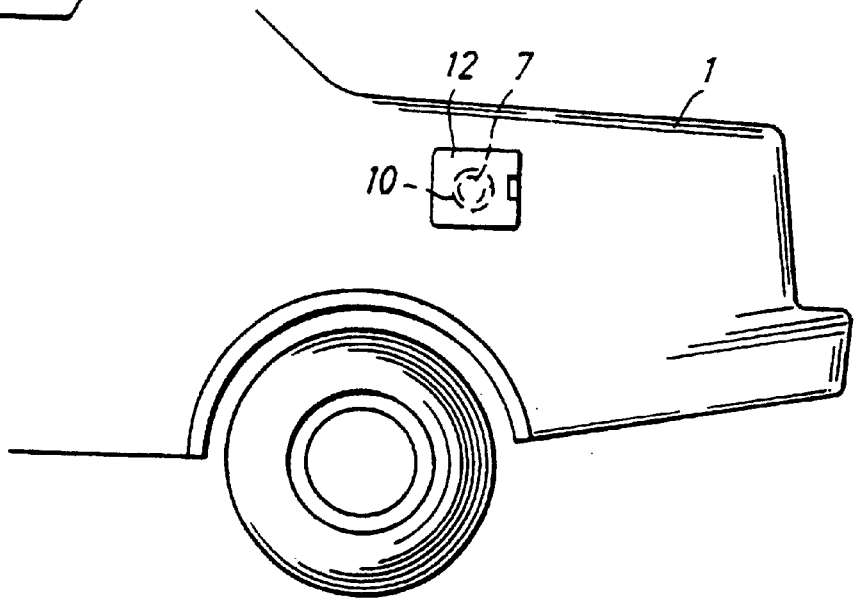
FIGS. 4 and 5 illustrate the rear part of one side of a vehicle, showing the fuel-tank flap.
Figure 5:
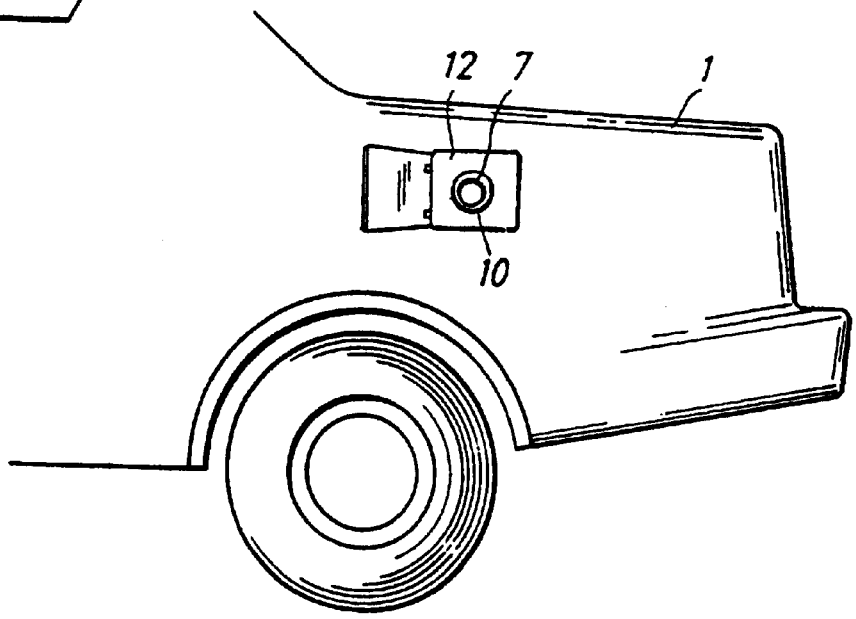

The front part of the robot head is shown in larger scale in FIG. 3. The robot head 3 includes an outer tube 8 and an inner tube 9 which is housed within the outer tube and which can be moved axially within said outer tube and outwardly therefrom. The outer tube 8 is intended to be docked with an adapter 10 attached to the upper orifice of the fuel-tank pipe 7. Subsequent to docking, the free, front end of the inner tube 9 is moved to a position further down in the fuel-tank pipe, whereafter fuel is delivered to the fuel-tank through the inner tube 9.

According to said patent, the robot head 3 is positioned relative to the fuel-tank pipe 7 of the vehicle by means of a positioning system that includes a transceiver unit 8*a* adjacent the robot head, which is preferably designed to operate at microwave frequencies, and a passive transponder 7*a* is mounted on the vehicle at a predetermined position in relation to the fuel-tank flap. The positioning system used is preferably the positioning system described in Swedish Patent Specification No. 8403564-1.

Figure 6:
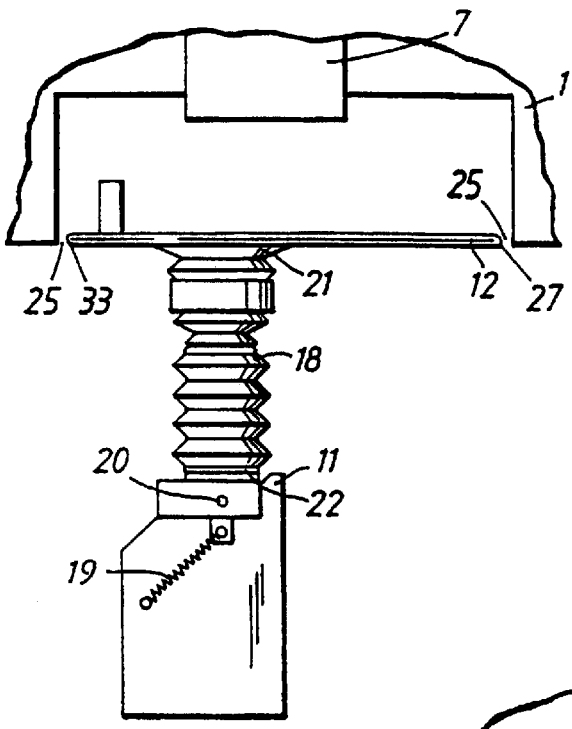
FIG. 6 illustrates schematically a closed fuel-tank flap and a flap opening device.

The robot head 3 carries a fuel-tank flap opening device 11, which is shown in larger scale in FIG. 6. The opening device 11 is constructed to open the fuel-tank flap 12 of a vehicle 1 in response to movements of the robot head.

Opening device 11 includes a resilient, bellows-like element 18 which is mounted for pivotal movement on a shaft 20 against a spring force exerted by a spring 19, said pivot shaft being located at right angles to the plane in which the robot head moves during an opening operation. The pivot shaft 20 will thus normally extend vertically. In its rest state, the bellows-like element 18 extends parallel with the outer tube 8 of the robot head. The forward, free end 21 of the bellows-like element 18 is open, whereas its other end 22 is connected to a suitable known source of sub-atmospheric pressure (not shown).

FIG. 6 shows the opening device in a position to which it has been brought by the robot head and in which the front end 21 of said element abuts a vehicle fuel-tank flap or cover plate 12, i.e. a position at which the opening operation shall commence.

An opening and docking sequence is carried out in the following way: The vehicle is placed in a predetermined position in relation to the robot, although reasonable deviations from this predetermined position are allowed, The robot is then positioned relative to the fuel-tank flap. Subsequent hereto, the robot computer guides the robot head for movement in accordance with a predetermined plan, wherein the opening device is moved to the position shown in FIG. 6, by means of the robot head. A sub-atmospheric pressure is then generated in the bellows-like element 18, which is thereby firmly drawn against the fuel-tank flap.

Figure 7:
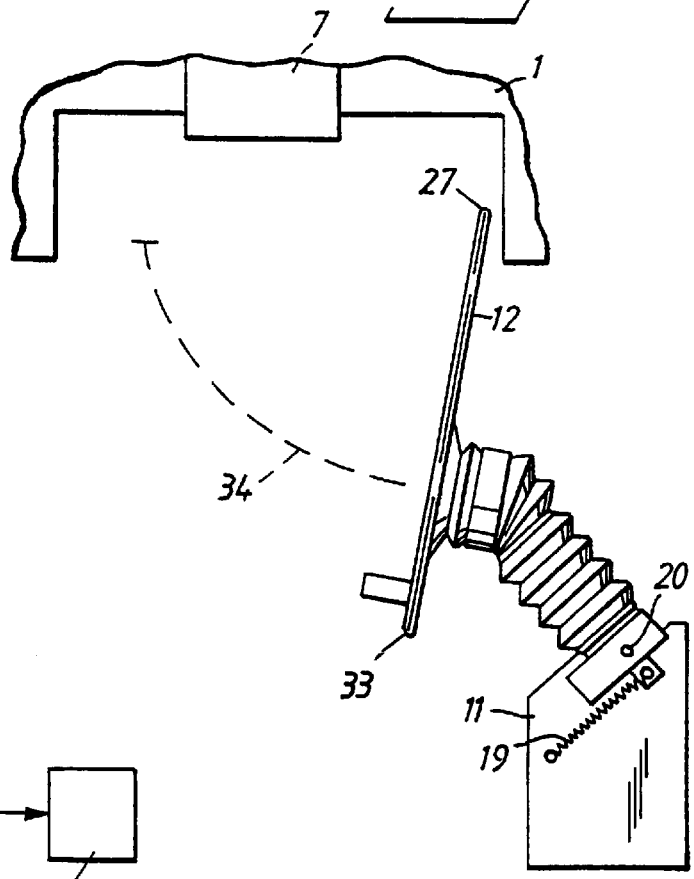
FIG. 7 illustrates schematically a fuel-tank flap opened by means of the opening device.

The robot head then continues to move in accordance with the movement plan until the position shown in FIG. 7 is reached, in which the fuel-tank flap has been opened.

Upon completion of this movement, the robot head docks the outer tube 8 with the adapter and the inner tube 9 is then inserted down into the fuel-tank pipe. Fuel is then delivered to the fuel-tank pipe through the inner tube.

When the vehicle has been refuelled, the afore described movements are carried out in the reverse order, thereby closing the fuel-tank flap and returning the robot to its original starting position.

FIGS. 6 and 7 show an example in which the fuel-tank flap 12 is pivoted about a vertical axis at one edge of the flap.

The features described above are also found described in the aforesaid Swedish patent specification.

One problem encountered resides in arranging microwave equipment in connection with the robot head and using the transponder to bring the robot to its starting position. Another problem is that the transponder must be positioned accurately in a predetermined location on the vehicle.

The present invention solves these problems.

According to the invention, the positioning system includes an optical sensor means 23 arranged in connection with the robot 2. The sensor means is adapted to detect optically the position of the fuel-tank flap 12 of a vehicle parked for fuelling in relation to the rest position of the robot head 3 and to deliver to a robot computer a signal relating to said relative position. The computer 29 is programmed to bring the opening device 11 on said robot into abutment with the fuel-tank flap and to open said flap in accordance with a predetermined movement plan.

After the fuel-tank flap has been opened, the sensor means 23 detects the position of the orifice of the fuel-tank pipe 7 or of the adapter 10 relative to the current position of the robot head 3, and therefor transmits to the computer 29 a signal relating to this relative position.

Thus, in accordance with the invention, the sensor means 23 detects both the position of the fuel-tank flap and the position of the fuelling orifice of adapter 10.

The computer 29 is programmed to thereafter cause the robot head 3 to carry out said docking, and also to carry out the aforesaid movements in the reverse order and therewith close the fuel-tank flap, when fuelling of the vehicle has been completed.

Figure 2:
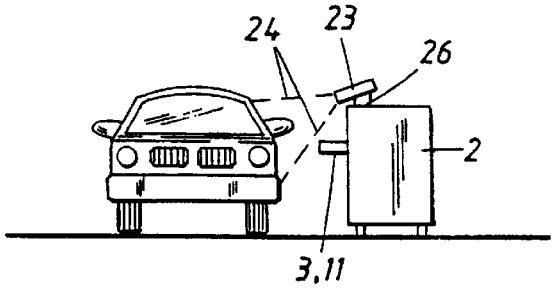
FIG. 2 is a front view of a vehicle positioned adjacent a robot.

The optical sensor means is suitably mounted on the upper part of the robot and inclined downwards, as shown in FIG. 2. The broken lines 24 in FIGS. 1 and 2 define the approximate extent of the area sensed or scanned by the sensor means.

According to one preferred embodiment, the optical sensor means is a suitable, known scanning laser, preferably an IR laser, and a signal processing circuit adapted to detect the fuel-tank flap and its position relative to the rest position of the robot head.

Several different kinds of scanning lasers suitable for use to this end are commercially available. Although the scanning laser used will preferably be a low-power IR laser, it will be understood that other lasers may alternatively be used. There may be used a scanning laser that deflects the laser light in mutually parallel lines in both a horizontal and vertical direction, such as a laser having a wobbling laser light deflecting mirror.

Such a laser can be used to detect reflected laser light and/or to measure distances.

In the illustrated embodiment, the laser is adapted conveniently to first scan a predetermined area within which the fuel-tank flap of a correctly parked car is located, and thereby detect the fuel-tank flap by detecting reflected laser light. It is well known to detect objects and shapes with the aid of scanning lasers. The fuel-tank flap can be readily identified by means of the signal processing circuit, by virtue of the channel-shaped recess or gap 25 that runs between the fuel-tank flap and the surrounding chassis. This circuit is programmed to look for a rectangular or round shape, formed by the channel-shaped recess.

The predetermined area may encompass part of one side of a vehicle or the whole of one side thereof. The robot may be arranged to move in the directions 4 along the whole of one side of a vehicle.

Subsequent to the laser having identified the fuel-tank flap, the signal processing circuit functions to determine the angles defined by the laser beam against the fuel-tank flap in the horizontal plane and the vertical plane. The laser then functions to measure the distance to some point on the flap. Knowledge of the aforesaid angles and said distance reveals the position of the fuel-tank flap relative to the robot head. This calculation is carried out suitably by the robot computer or by a computer that includes the signal processing circuit.

According to one alternative embodiment, the optical sensor means includes an appropriate, known device for detecting visible light, such as a lens and a CCD element, i.e. video equipment, and a signal processing circuit adapted to detect the fuel-tank flap and its position relative to the rest position of the robot head by image processing. It is well known to detect objects by image processing. In this respect, the fuel-tank flap is detected in a manner corresponding to that described above, whereby the channel-like recess or gap 25 extending around the flap is detected by virtue of its shape. The aforesaid angles are then determined by the signal processing circuit The distance to the fuel-tank flap is determined by the video equipment focusing on the flap and thereby sensing the set focal distance. The video equipment may also be movable around a suspension point 26 (see FIG. 2), so as to enable the equipment to be brought into alignment with the fuel-tank flap and therewith determine the distance to said flap with the aid of a known autofocus system of the kind used on video cameras. The video equipment may also be arranged to zoom in the fuel-tank flap and therewith enhance the accuracy at which distance is determined by means of said autofocus system.

The sensor means is adapted to detect the position of the orifice of the fuel-tank pipe or of the adapter in relation to the position of the robot head, after the fuel-tank flap has been opened.

It is preferred that the edge surface 35 of the adapter 10 around the adapter orifice has a reflectivity that differs from the reflectivity of the remainder of the adapter. This enables the optical sensor means to detect the orifice more readily.

According to one highly preferred embodiment of the invention, the predetermined movement plan for opening the fuel-tank flap includes the free end 21 of said opening device 11 gripping the flap 12 between its center point and the rear edge 33 of said flap when said flap is pivotable. The movable plan pivotal and includes a movement component that extends outwards and in a direction about the front edge 27 of said flap. The free end 21 of the opening device will preferably engage the flap close to its rear edge 33, as opposed to its front edge 27, so as to reduce the pulling force required to open the flap.

An automatic fuelling station of the present kind is constructed so that cars whose fuel-tank flaps are on the right side of the car drive to a position on the left of a robot, whereas cars whose fuel-tank flaps are on the left side of the car drive to a position on the right of a robot. Alternatively, a robot may be provided on each side of the drive-in. The driving direction is always the same when fuelling a vehicle at a given robot. Since almost all makes of car have a fuel-tank flap which is hinged at the front edge of the flap, as seen relative to the front of the car, the robot need not be provided with information as to the edge on which the flap is hinged.

According to one embodiment of the invention, the sensor means and the computer are adapted to detect the shape and size of the fuel-tank flap.

According to another preferred embodiment of the invention the computer is programmed to calculate the centroid or center of gravity of the surface of the fuel-tank flap and to calculate the position of said point relative to the position of the robot head. This enables the position of the flap relative to the rest position of the robot to be determined very accurately.

According to one important embodiment, the computer is programmed to calculate the aforesaid predetermined movement plan for opening and closing the fuel-tank flap on the basis of the size of the fuel-tank flap 12 and the point at which the opening device 11 will come to engage the flap. In this regard, movement of the opening device 11 can be calculated so that the free end of the bellows-like element will follow the broken line 34 in FIG. 7.

Figure 8:
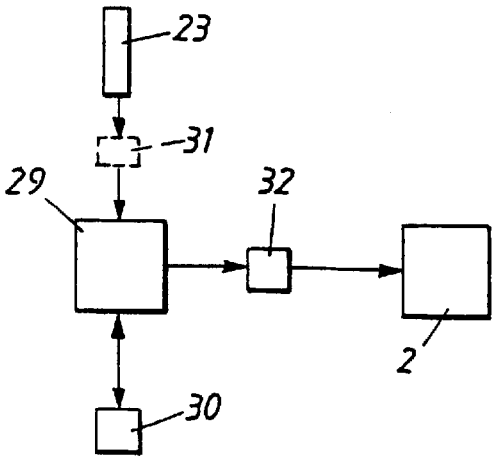
FIG. 8 is a block schematic of the control elements of one form of the invention.

FIG. 8 is a block schematic illustrating the invention, where the robot computer is referenced 29. The computer memory is referenced 30. The sensor means 23 sends to the computer signals that are processed in a signal processing circuit referenced 31. This circuit may be included in the computer or may be completely or partially separate therefrom, as indicated in broken lines, and in such case connected to the computer. The computer actuates operating circuits 32 on the basis of these calculations, these circuits actuating the robot 2 in turn.

It will be apparent from the aforegoing that of the robot, opening of the fuel-tank flap and docking are easier to carry out, since only one sensor means is required and since this sensor is mounted separate from the robot head. Neither is it necessary to include means for transferring a code to the robot so as to enable it to carry out a predetermined movement plan. Furthermore, the invention obviates the need of using microwave equipment.

It will also be apparent that the present invention enables the owner of a vehicle to begin using an automatic fuelling system very easily. All the owner is required to do is to provide the vehicle with an adapter. No transponders or other codes need be mounted on the vehicle.

Although the invention has been described above with reference to a number or exemplifying embodiments thereof, it will be understood by the person skilled in this art that modifications can be made.

The present invention is therefore not restricted to these embodiments, since modifications and variations can be made within the scope of the following claims.

What is claimed is:

1. A positioning arrangement pertaining to the automatic fuelling of vehicles, primarily cars, said arrangement comprising: a robot which includes a robot head that is movable relative to said robot to enable the robot head to be brought from a rest position to a predetermined position relative to a vehicle fuel-tank pipe, wherein the robot head includes an outer tube and an inner tube housed within said outer tube and movable axially out of said outer tube, wherein the outer tube is adapted to be docked with an inlet orifice of the fuel-tank pipe so that subsequent to docking of said outer tube, a free forward end of the inner tube is extended into the fuel-tank pipe to deliver fuel through the inner tube and into the fuel-tank pipe, the robot head including a fuel-tank flap opening device tat includes a flexible member having an open, free end which is adapted to engage a fuel-tank flap of said vehicle through the application of sub-atmospheric pressure in said flexible member, said opening device operable to open tie fuel-tank flap in response to movements of the robot head, said movements taking place in accordance with a predetermined fuel tank flap movement plan, an optical sensor carried by the robot to optically scan a body panel of the vehicle to detect the position, relative to the rest position of the robot head, of the fuel-tank flap by detecting the position of a gap between edges of the fuel-tank flap and a surrounding vehicle body panel surface on a vehicle parked for fuelling purposes and to transmit to a robot computer a first signal relating to said relative position of the fuel-tank flap; wherein the vehicle does not carry a signal-transmitting element for providing a signal to the robot that enables the robot to detect the fuel-tank flap; wherein the computer is programmed to guide the opening device of said robot head into abutment with the fuel-tank flap and to open said flap in accordance with the predetermined fuel-tank flap movement plan; wherein the sensor optically detects the position of a fuel-tank pipe orifice relative to the position of the robot head after the fuel-tank flap has been opened, and wherein the computer receives a second signal relating to that relative position of the fuel-tank pipe orifice; and wherein in response to the first and second position signals the computer provides output signals to cause the robot head to effect docking, and to carry out robot head movements in a reverse order and therewith close the fuel-tank flap when fuelling of the vehicle has been completed.

2. An arrangement according to claim 1, wherein the optical sensor includes a laser, and the positioning arrangement includes a signal processing circuit for receiving an output signal from the sensor indicative of the fuel-tank flap and its position relative to the rest position of the robot head, and also indicative of the position of the orifice of the fuel-tank pipe relative to the position of the robot head.

3. An arrangement according to claim 2, wherein the laser is an IR laser.

4. An arrangement according to claim 2, wherein the laser is a scanning laser that deflects laser light in mutually parallel lines in both horizontal and vertical directions.

5. An arrangement according to claim 1, wherein the optical sensor includes a visible light detecting device, and the positioning arrangement includes a signal processing circuit for receiving an output signal from the sensor indicative of the fuel-tank flap and its position relative to the rest position of the robot head and also indicative of the position of the orifice of the fuel-tank pipe relative to the position of the robot head.

6. An arrangement according to claim 5, wherein the visible light detecting device includes a lens and a CCD element.

7. An arrangement according to claim 1, wherein the sensor is operable to detect the shape and the size of the fuel-tank flap.

8. An arrangement according to claim 7, wherein sensor output signals are transmitted to the computer to determine the position of the centroid of the fuel-tank flap and to determine the position of the fuel-tank flap centroid relative to the position of the robot head.

9. An arrangement according to claim 8, wherein said predetermined movement plan for opening the fuel-tank flap includes the free end of said opening device engaging the fuel-tank flap between its centroid and a flap rear edge, wherein the flap is hinged, and wherein the movement plan includes an outwardly directed movement component and a movement component directed towards a front edge of said flap.

10. An arrangement according to claim 9, wherein the computer is programmed to calculate distances corresponding with the predetermined movement plan for opening and closing the fuel-tank flap on the basis of the size of said flap and on a calculated point at which the opening device engages said flap.

11. An arrangement according to claim 1, wherein an edge surface around the orifice of the fuel-tank pipe has a reflectivity that differs from the reflectivity of structure surrounding the orifice, to facilitate detection of the orifice by the optical sensor.

12. An arrangement according to claim 1, wherein the inlet orifice of the fuel-tank pipe includes an adapter.

13. An arrangement according to claim 12, wherein the adapter has a reflectivity that differs from the reflectivity of structure surrounding the orifice, to facilitate detection of the orifice by the optical sensor.

14. An arrangement according to claim 1, wherein the optical sensor is a unitary sensor that is carried by the robot, and the vehicle does not carry a fuel-tank flap position transmitting means.

15. An arrangement according to claim 14, wherein the optical sensor includes a laser, and the positioning arrangement includes a signal processing circuit for receiving an output signal from the sensor indicative of the fuel-tank flap and its position relative to the rest position of the robot head, and also indicative of the position of the orifice of the fuel-tank pipe relative to the position of the robot head.

16. An arrangement according to claim 15, wherein the laser is a scanning laser that deflects laser light in mutually parallel lines in both horizontal and vertical directions.

* * * * *